US005388370A

United States Patent [19]

Tönsmann

[11] Patent Number: 5,388,370

[45] Date of Patent: Feb. 14, 1995

[54] TRANSMISSION FOR ADJUSTABLE SASHES IN DOOR-OR WINDOW FRAMES

[75] Inventor: Armin Tönsmann, Bielefeld, Germany

[73] Assignee: Schüco International KG, Bielefeld, Germany

[21] Appl. No.: 42,248

[22] Filed: Apr. 2, 1993

[30] Foreign Application Priority Data

Apr. 6, 1992 [DE] Germany ..... 4211464

[51] Int. Cl.[6] ..... E05F 17/00

[52] U.S. Cl. ..... 49/100; 49/362

[58] Field of Search ..... 74/89.17; 49/100, 138, 49/362

[56] References Cited

U.S. PATENT DOCUMENTS

| | | | |
|---|---|---|---|
| 832,010 | 9/1906 | Cossey | 49/100 |
| 858,147 | 6/1907 | Browne | 49/100 |
| 1,005,281 | 10/1911 | Murphy | 49/100 |
| 1,082,129 | 12/1913 | McCabe | 49/100 |
| 2,808,626 | 10/1957 | Sassano | 49/362 X |
| 3,241,283 | 3/1966 | Ahlgren | 49/362 X |
| 3,994,093 | 11/1976 | Mayer | 49/192 |

FOREIGN PATENT DOCUMENTS 8814754 2/1989 Germany .

*Primary Examiner*—Peter M. Cuomo
*Assistant Examiner*—Jerry Redman
*Attorney, Agent, or Firm*—Darby & Darby

[57] ABSTRACT

One stile of the sash in a door or window frame has an elongated channel for an elongated trough-shaped gear case rotatably receiving a first gear in mesh with the toothed rack of a reciprocable carrier in the gear case. A bifurcated end portion of the carrier mounts a second gear which meshes with a fixed rack of the gear case and with an elongated rack which is slidable along and overlies an open side of the gear case. The first gear can be rotated by a handle to move the carrier whereby the second gear rolls along the fixed rack and causes the elongated rack to perform a movement greater than the carrier. The elongated rack is coupled to motion receiving bars in the channel of the stile.

16 Claims, 3 Drawing Sheets

TRANSMISSION FOR ADJUSTABLE SASHES IN DOOR-OR WINDOW FRAMES

BACKGROUND OF THE INVENTION

The invention relates to transmissions in general, and more particularly to improvements in transmissions which can be utilized with advantage in windows and/or doors, for example, in windows or doors employing sashes which are pivotable about pairs of mutually inclined axes.

Commonly owned German Utility Model No. 88 14 754.1 (published Feb. 16, 1989) discloses a transmission in a housing which occupies a rather substantial amount of space so that it cannot be readily installed in a stile of a standard door- or window sash. Such stiles are normally mass-produced in extruding machines. In order to install a housing and a transmission of the type disclosed in the German Utility Model in a standard stile, it is necessary to provide in the deepmost portion of a channel in the stile a separately machined groove to thus provide room for certain motion receiving parts which are coupled to or are otherwise actuatable by the transmission. The housing confines a pinion which can be rotated by a handle to shift a toothed rack which, in turn, is mounted to actuate the aforementioned motion receiving parts.

U.S. Pat. No. 3,994,093 granted Nov. 30, 1976 to Meyer et al. discloses a window with a sash which is installed to perform pivotal movements about two mutually inclined axes, namely about a horizontal axis adjacent the lower rail of the sash or about a vertical axis adjacent one stile of the sash. As a rule, the handle which must be actuated to lock or pivot a sash of the just outlined character is mounted for angular movement through an angle of 180°. The sash is locked in one end position of the handle, the sash is pivotable about one of the axes after the handle is moved from the one end position through an angle of 90°, and the sash can be pivoted about the other axis upon movement of the handle to the other end position. The disclosure of the patent to Meyer et al. is incorporated herein by reference.

The extent of movement of the toothed rack which receives motion from the pinion of a conventional transmission for use in window or door sashes depends upon the diameter of the pinion. Therefore, if the pinion is to be directly rotated by a handle, a stile of a door or window sash must afford sufficient room for installation of a toothed rack and a pinion having a diameter which suffices to move the rack back and forth through distances of required length, i.e., to shift the motion receiving member or members to an extent which is necessary to lock the sash, to prepare the sash for pivotal movement about one of the two axes, or to prepare the sash for pivotal movement about the other axis.

OBJECTS OF THE INVENTION

An object of the invention is to provide a compact transmission which can be installed in existing sashes or in new sashes having standard dimensions.

Another object of the invention is to provide a transmission which can be installed in an existing sash without necessitating any modifications of the component parts of such sash.

A further object of the invention is to provide a transmission which can employ a small-diameter pinion but is still capable of shifting one or more motion receiving parts through considerable distances.

An additional object of the invention is to provide a novel and improved gear transmission which employs a plurality of toothed racks and pinions.

Still another object of the invention is to provide a novel and improved combination of toothed racks and pinions for use in a transmission, particularly in a transmission which can be installed in a door or window sash.

A further object of the invention is to provide a door or window sash which embodies a transmission of the above outlined character.

Another object of the invention is to provide a door or window which embodies a sash with a transmission of the above outlined character.

An additional object of the invention is to provide the above outlined transmission with novel and improved means for guiding its moving parts in a sash and/or in a gear case.

Still another object of the invention is to provide a novel and improved gear case for use in the above outlined gear transmission.

A further object of the invention is to provide the transmission with novel and improved means for increasing the extent of movability of the output element of the transmission.

Another object of the invention is to provide the transmission with novel and improved means for increasing the extent of movability of the output element of the transmission without contributing to the bulk of the transmission.

An additional object of the invention is to provide a novel and improved method of increasing the extent of movability of the output element of a gear transmission which employs pinions and toothed racks.

SUMMARY OF THE INVENTION

The invention is embodied in a transmission which can be utilized with particular advantage for moving a door sash or a window sash relative to a door or window frame. The improved transmission comprises a support which can constitute a gear case and is receivable in a sash, an elongated carrier at the support (for example, within the confines of the support), means for moving the carrier longitudinally relative to the support, a first gear which is rotatably mounted on the carrier and mates with a first toothed rack which is provided on the support and is preferably at least substantially parallel to the elongated carrier, and a second toothed rack which mates with and is movable (preferably in at least substantial parallelism with the elongated carrier) in response to rotation of the first gear as a result of longitudinal movement of the carrier, i.e., as a result of rolling of the first gear along the first rack.

The carrier can include or can constitute a third toothed rack, and the moving means can comprise a second gear which is rotatably journalled in the support and mates with the third rack. The moving means can further comprise a handle which is arranged to be carried by the sash and has means for rotating the second gear.

At least one reciprocable motion receiving element can be received in the sash and is then coupled to and receives motion from the second rack.

The first toothed rack can be rigid (e.g., of one piece) with the support. The latter can comprise a plurality of elongated walls and a longitudinally extending groove provided in at least one of the walls and serving to receive a tongue of the sash. Such walls can include two sidewalls and a third wall. The groove is provided in one of the sidewalls and the third wall can be moved to a position adjacent a bottom wall in an elongated channel of the sash.

The carrier can include or constitute an elongated pusher having a forked end portion with two prongs, and the first gear can be disposed between and can be rotatably journalled in the prongs. The third rack can form part of the pusher.

The second rack can have a substantially U-shaped cross-sectional outline and can overlie an open side of the support. The support and the second rack can be provided with cooperating first and second guide means which confine the second rack to reciprocatory movements relative to the support. The guide means can comprise at least one elongated track in the support and at least one follower which is provided on the second rack and engages the at least one track. The support and/or the second rack can comprise a plurality of elongated sections. For example, at least one of these parts can be assembled of two sections which are or which can be mirror images of each other.

The second gear can be provided with a polygonal (or any otherwise configurated non-circular) socket which registers with an opening of the sash, and the moving means can further comprise the aforementioned handle which is then provided with a polygonal working end insertable through the opening and into the socket to rotate the second gear. The second gear can be installed in a substantially cylindrical recess of the support. The diameter of the recess can approximate the outside diameter of the second gear and the latter can comprise at least one axial extension having an outer diameter which approximates the root diameter of the second gear and is journalled in the support.

The carrier and the second rack can be provided with cooperating guide means which permit longitudinal movements of the second rack and the carrier relative to each other. It is further possible to provide cooperating guide means on the support and on the carrier so as to permit longitudinal movements of the carrier relative to the support.

The novel features which are considered as characteristic of the invention are set forth in particular in the appended claims. The improved transmission itself, however, both as to its construction and its mode of operation, together with additional features and advantages thereof, will be best understood upon perusal of the following detailed description of certain presently preferred specific embodiments with reference to the accompanying drawings.

DESCRIPTION OF PREFERRED EMBODIMENTS

Figure 4:
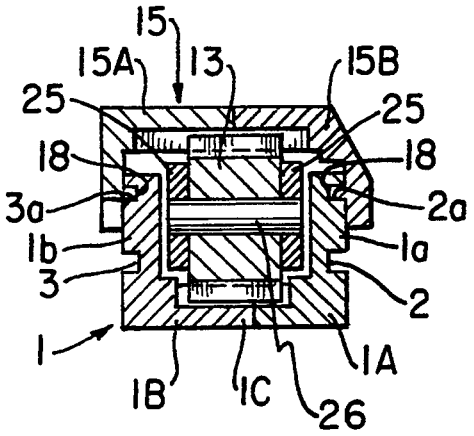
FIG. 4 is a transverse sectional view as seen in the direction of arrows from the line IV—IV in FIG. 3.
Figure 5:
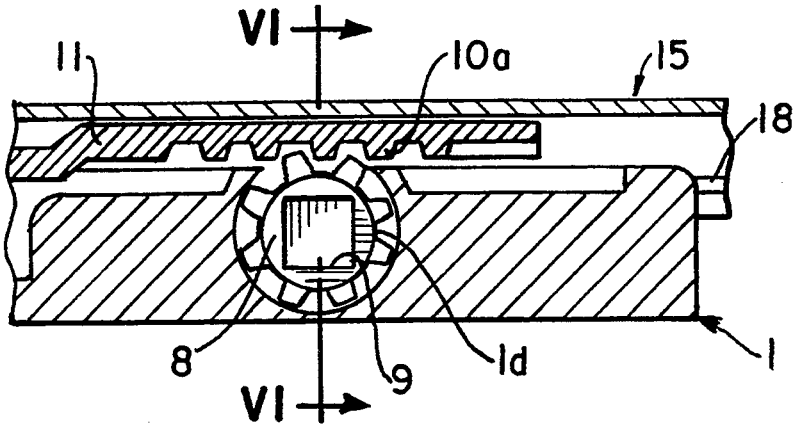
FIG. 5 is an enlarged view of another detail in the transmission of FIG. 1.

The transmission which is shown in the drawings comprises an elongated narrow support 1 which constitutes a gear case or housing and has a substantially U-shaped cross-sectional outline (see FIG. 4). This support is assembled of two elongated sections 1A, 1B and includes two spaced apart sidewalls 1*a*, 1*b* and a third wall 1*c* between the two sidewalls. The outer sides of the sidewalls 1*a* and 1*b* are respectively provided with longitudinally extending grooves 2 and 3 for reception of tongues 6 (FIG. 6) forming part of a stile 5 which, in turn, forms part of a door or window sash. The stile 5 has a longitudinally extending channel 4 adjacent a bottom wall 19. When the support 1 is properly installed in the channel 4, its third wall 1*c* is adjacent the bottom wall 19 (this can be seen in FIG. 6).

The support 1 accommodates an elongated carrier 11 having a first end portion provided with or constituting a toothed rack 10*a* and a second end portion 12 with two prongs 25 (FIG. 4) for the shaft 26 of a gear or pinion 13. The latter mates (a) with a toothed rack 14, which is of one piece with the support 1, and (b) with a toothed rack 15 which can be said to constitute the output element of the transmission and overlies an open side of the support 1. As can be seen in FIG. 4, the rack 15 is also assembled of two elongated sections 15A, 15B which can but need not be exact mirror images of each other and each of which has an inwardly extending follower 18 received in a longitudinally extending track 2*a*, 3*a* provided in the respective sidewall 1*a* or 1*b* of the support 1. The rack 15 has a substantially U-shaped cross-sectional outline. The followers 18 of the rack 15 and the tracks 2*a*, 3*a* of the support 1 respectively constitute cooperating first and second guide means which confine the rack 15 to reciprocatory movements in the longitudinal direction of the support 1, i.e., in the longitudinal direction of the carrier 11 and its rack 10*a* as well as in the longitudinal direction of the rack 14.

The carrier 11 and the rack 15 preferably also comprise cooperating guide means for confining these parts to reciprocatory movements relative to each other in the longitudinal direction of the carrier. The aforementioned prongs 25 (FIG. 4) can constitute one component and the adjacent internal surfaces of the rack 15 can constitute the other component of such guide means.

The means for moving the carrier 11 longitudinally of the support 1 and racks 14, 15 comprises the aforementioned rack 10*a* on the carrier 11, a pinion or gear 8 which is rotatably journalled in the support 1 and mates with the rack 10*a*, and a preferably detachable handle or actuator 7 (FIG. 6) having a non-circular (e.g., square) working end 10 which can be caused to pass through an opening 22 of the stile 5 forming part of a door or window sash and into a complementary socket 9 of the gear 8.

The outside diameter of the gear 8 is only slightly smaller than the diameter of a substantially cylindrical recess 1*d* of the support 1. The end portions of the gear 8 have extensions 21 with an outer diameter approximating the root diameter of the gear 8, and these extensions 21 are rotatably journalled in the support 1. Such journalling of the gear 8 ensures that the gear is not likely to be tilted and/or to jam in the support 1 when the socket 9 receives the working end 10 of the handle 7 and the latter is rotated to move the carrier longitudinally of the support 1 and racks 14, 15. The support 1 is configurated in such a way that its internal surfaces have suitably dimensioned recesses or sockets for the extensions 21; thus, it is not necessary to provide any discrete parts for the express purpose of ensuring adequate mounting of the gear 8 in the support 1. When the two sections 1A and 1B of the support 1 are properly secured (e.g., welded or glued) to each other, the gear 8 is automatically journalled between such sections.

Figure 1:
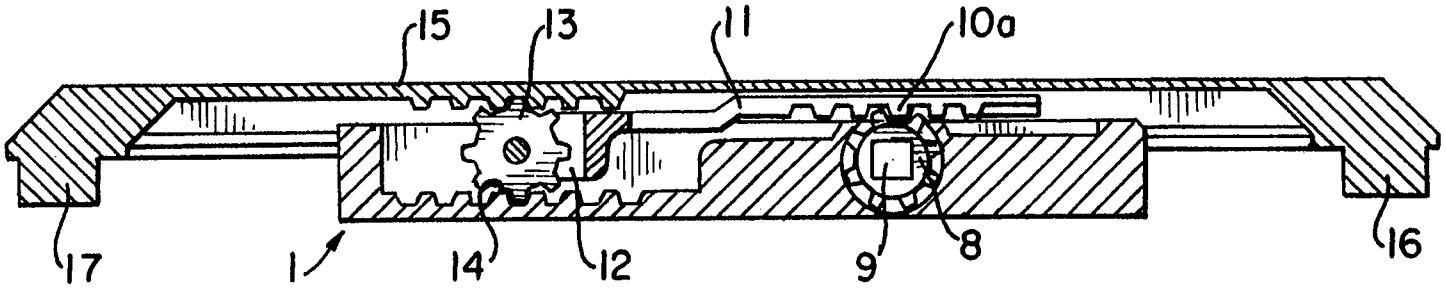
FIG. 1 is a longitudinal sectional view of a transmission which embodies one form of the invention, with the handle removed.
Figure 7:
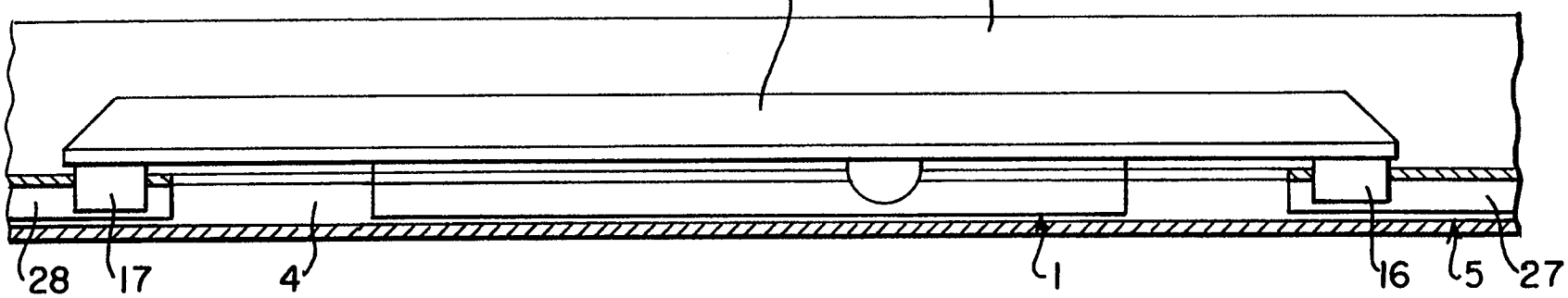
FIG. 7 illustrates the transmission upon installation in a door or window sash, and further showing a portion of the door or window frame.

The end portions of the rack 15 are provided with motion transmitting projections 16, 17 which enter complementary holes in motion receiving bars 27, 28, respectively. Such bars are installed in the channel 4 of the stile 5 forming part of a door or window sash (see FIG. 7) which is adjacent a door or window frame F (also shown in FIG. 7) when the sash is maintained in closed position.

Figure 6:
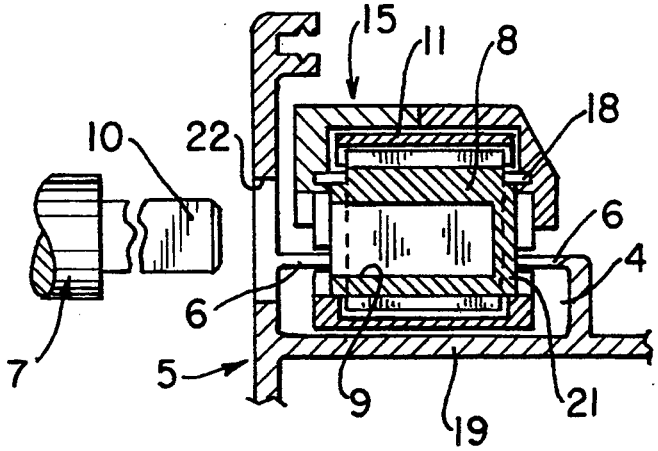
FIG. 6 is a transverse sectional view as seen in the direction of arrows from the line VI—VI in FIG. 5, and further shows a portion of a handle which can be utilized to rotate the second gear.

The profile of the stile 5 which is shown in FIG. 6 can be said to be a standard profile, and this stile can readily receive the improved transmission without any changes, i.e., without the provision of any additional grooves or recesses which are necessary to permit the installation of a transmission of the type described and shown in the aforementioned German Utility Model. FIGS. 4 and 6 further show that the rack 15 need not extend all the way to the tongues 6 of the stile 5. The followers 18 are spaced apart from the tongues 6.

The mode of operation of the improved transmission will be described with reference to FIG. 2.

Figure 2:
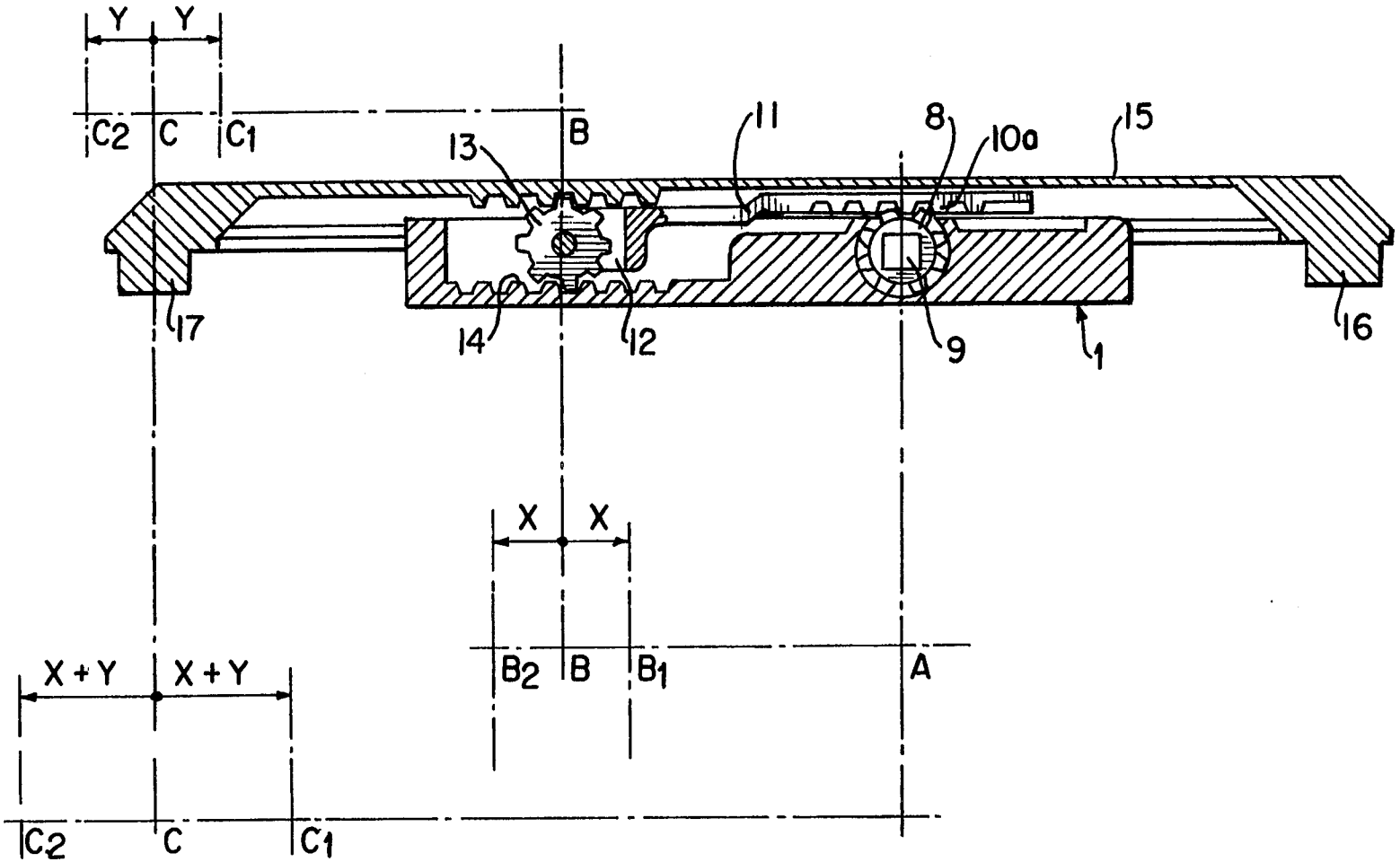
FIG. 2 is a similar sectional view and further shows the distances which are covered by the second toothed rack in response to rotation of the second gear.
Figure 3:
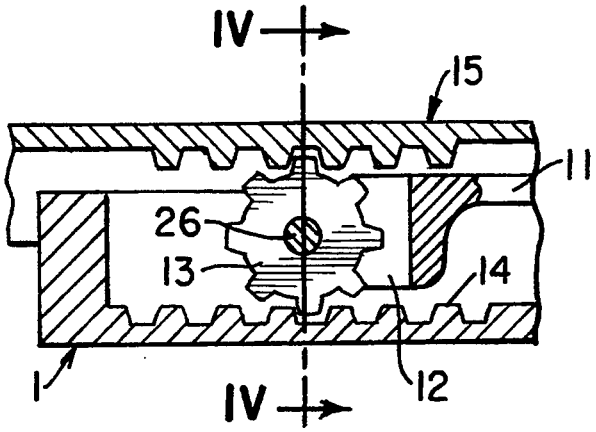
FIG. 3 is an enlarged view of a detail in the transmission of FIG. 1.

When the gear 13 assumes the neutral or median angular position of FIG. 2, its axis is located in a plane B. The axis of the gear 8 is always located in a plane A which is parallel to and is spaced apart from the plane B. If the gear 8 is turned through 90° in a counterclockwise direction, the teeth of this gear cooperate with the teeth of the rack 10*a* to move the axis of the gear 13 into a plane $B_2$ through a distance x. If the gear 8 is rotated through 90° in a clockwise direction, as viewed in FIG. 2, the axis of the gear 13 is again moved through a distance x but in the opposite direction, namely into the plane $B_1$. Since the gear 13 rolls along and mates with the fixedly mounted rack 14 during movement of the carrier 11 in response to rotation of the gear 8 from the illustrated position to the one or the other end position, the gear 13 causes the projection 17 of the rack 15 (output element) to cover a distance $x+y$ from a neutral position C to a position $C_1$ or $C_2$, depending on the direction of rotation of the gears 8 and 13. Thus, the rack 15, and hence its projections 16, 17 (as well as the motion receiving bars 27, 28) will cover a distance $x+y$ which is greater than the distance x. If the gear 13 were omitted and the rack 15 were to mesh directly with the gear 8, the projection 17 would move only through a distance y from the plane C into the plane $C_1$ or $C_2$. The bars 27 and 28 perform those movements which are necessary to lock the sash in closed position, to prepare the sash for pivotal movement about a horizontal axis, or to prepare the sash for pivotal movement about a vertical axis. The exact manner in which the sash is to be locked or prepared for pivoting about a horizontal or vertical axis forms no part of the present invention.

The opening 22 can be provided at the outer side or at the inner side of the stile 5.

An important advantage of the improved transmission is that the gears 8 and 13 need not be maintained in direct mesh with each other. Instead, these gears are operatively connected to each other by the carrier 11 whose end portion 12 mounts the gear 13 and whose rack 10*a* meshes with the gear 8. Nearly the full width of the transmission can be utilized to install gears of substantial axial length. This enhances the stability of the gears and of the entire transmission and reduces the extent of wear upon the teeth of such gears. Moreover, it is possible to install each of these gears in an optimum position for engagement of the gear 8 by the working end 10 of a handle 7 and for mating of the gear 13 with the racks 14 and 15. Since each of the gears 8 and 13 can have a considerable axial length, the diameters of these gears can be small so that the transverse dimensions of the support 1, rack 15 and particularly the stile 5 need not be increased for the express purpose of installing gears whose stability suffices to ensure that the transmission will stand long periods of frequent use.

Another important advantage of the improved transmission is that the extent of movability of the projections 16, 17 and motion receiving bars 27, 28 longitudinally of the racks 14, 15 and support 1 can be varied within a wide range as well as that the initial or neutral positions of the projections 16 and 17 can be selected practically at will without necessitating the utilization of a specially designed sash.

A further important advantage of the improved transmission is that all of its reciprocable parts (such as the carrier 11 and its rack 10*a*, the rack 14 and the rack 15) can be readily confined to linear movements in a simple and space-saving manner. The extent of linear movability of the rack 15 can greatly exceed the extent of linear movability of the carrier 11 because the latter causes the gear 13 to rotate about the axis of the shaft 26 as well as to roll along (i.e., to perform a translatory movement relative to) the rack 14 so that the extent of longitudinal movements of the rack 15 can considerably exceed the extent of longitudinal movements of the carrier.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A transmission, particularly for moving a sash relative to a frame, comprising a support receivable in a sash; an elongated carrier movably connected to said support; means for moving said carrier longitudinally relative to said support; a gear rotatably mounted on said carrier and mating with a first toothed rack provided on said support; and a second toothed rack, mating with said gear, being movably connected to said support and being movable in response to rotation of said gear as a result of longitudinal movement of said carrier; and wherein said carrier includes a third toothed rack and said moving means comprises a second gear rotatably journalled in said support and mating with said third rack.

2. The transmission of claim 1, wherein said moving means further comprises a handle arranged to be carried by the sash and having means for rotating said second gear.

3. The transmission of claim 1, further comprising at least one reciprocable motion receiving element arranged to be received in the sash and being coupled to said second toothed rack.

4. The transmission of claim 1, wherein said first toothed rack is rigid with said support.

5. The transmission of claim 1, wherein said support includes an elongated case having a plurality of elongated walls and a longitudinally extending groove provided in at least one of said walls and arranged to receive a tongue of the sash.

6. The transmission of claim 5, wherein said walls include two sidewalls and a third wall, said groove being provided in one of said sidewalls and said third wall being movable to a position adjacent a bottom wall in an elongated channel of the sash.

7. The transmission of claim 1, wherein said carrier includes an elongated pusher having a forked portion with two prongs, said gear being disposed between and being rotatably journalled in said prongs.

8. The transmission of claim 7, wherein said moving means comprises a toothed rack on said pusher.

9. The transmission of claim 1, wherein said support has an open side and said second toothed rack has a substantially U-shaped cross-sectional outline and overlies the open side of said support, said support and said second rack having cooperating first and second guide means confining said second rack to reciprocatory movements relative to said support.

10. The transmission of claim 9, wherein said guide means comprises at least one elongated track in said support and at least one follower provided on said second rack and engaging said at least one track.

11. The transmission of claim 9, wherein at least one of said support and said second rack comprises a plurality of elongated sections.

12. The transmission of claim 1, wherein said moving means comprises a second gear rotatably mounted in said support and mating with a toothed rack of said carrier, said second gear having a polygonal socket arranged to register with an opening of the sash and said moving means further comprising a handle having a polygonal working end insertable through the opening and into said socket to rotate said second gear.

13. The transmission of claim 1, wherein said moving means comprises a second gear rotatably installed in a substantially cylindrical recess of said support and mating with a toothed rack of said carrier.

14. The transmission of claim 13, wherein said second gear has an outside diameter and a root diameter, said recess having a diameter approximating said outside diameter and said second gear comprising at least one axial extension having an outer diameter approximating said root diameter and being journalled in said support.

15. The transmission of claim 1, wherein said carrier and said second rack comprise cooperating guide means permitting longitudinal movements of said second rack and said carrier relative to each other.

16. The transmission of claim 1, wherein said support and said carrier comprise cooperating guide means permitting longitudinal movements of said carrier relative to said support.

* * * * *